US005885019A

United States Patent [19]

Stear

[11] Patent Number: 5,885,019

[45] Date of Patent: Mar. 23, 1999

[54] SCRUBBER ATTACHMENT FOR SPRAY BOTTLE

[76] Inventor: Roger K. Stear, 180037 Ridgeway Dr., Mitchell, Nebr. 69357

[21] Appl. No.: 22,435

[22] Filed: Feb. 12, 1998

Related U.S. Application Data

[60] Provisional application No. 60/040,004 Mar. 3, 1997.

[51] Int. Cl.[6] ..... A46B 11/02; A46B 11/06

[52] U.S. Cl. ..... 401/137; 401/139; 401/190; 401/288; 401/289; 401/290

[58] Field of Search ..... 401/137, 139, 401/190, 288, 289, 290

[56] References Cited

U.S. PATENT DOCUMENTS

| | | | |
|---|---|---|---|
| D. 288,502 | 3/1987 | Barkley | 401/190 X |
| 1,578,449 | 3/1926 | Leraas | 401/288 X |
| 2,388,605 | 5/1945 | Eisner | 401/139 |
| 2,722,701 | 2/1955 | Blum et al. | 401/139 |
| 2,828,500 | 5/1958 | Peacock | 401/137 |
| 2,897,526 | 8/1959 | Dootson | 401/190 X |
| 3,008,164 | 2/1961 | Herman et al. | 401/139 |
| 3,164,856 | 1/1965 | Samaras et al. | 401/190 |
| 3,346,908 | 10/1967 | Johnson | 401/190 X |
| 3,637,141 | 1/1972 | Gores | 401/139 X |
| 4,311,404 | 1/1982 | Kodera | 401/289 X |
| 4,464,072 | 8/1984 | Norwell | 401/139 |
| 4,848,946 | 7/1989 | Goncalves | 401/190 X |
| 4,922,859 | 5/1990 | Durell et al. | 401/139 |

*Primary Examiner*—Steven A. Bratlie

[57] ABSTRACT

A scrubber attachment is provided for a spray bottle which includes a spray nozzle. The scrubber attachment includes a base member which includes a top side, a bottom side, and a communication channel extending through the base member from the top side to the bottom side. Scrubber members are connected to the top side of the base member astride the communication channel. A bottle connector is attached to the bottom side of the base member for connecting the scrubber attachment to the spray bottle. The scrubber attachment of the invention permits a surface to be treated with a liquid spray and scrubbed with scrubber members by using a one-handed operation. The bottle connector includes a flexible, tubular, connector sleeve placed in registration with the communication channel. The connector sleeve may be connected to the base member by a rotatable connection. The rotatable connection may include an annular recess in the base member which is in registration with the communication channel and may also include a flanged end on the connector sleeve which fits into the annular recess in the base member. The scrubber members include bristles. The spray nozzle of the spray bottle protrudes from a sprayer housing and the connector sleeve fits onto the protruding spray nozzle by a friction fit. The scrubber members are distributed symmetrically around the communication channel on the base member.

2 Claims, 2 Drawing Sheets

SCRUBBER ATTACHMENT FOR SPRAY BOTTLE

BACKGROUND OF THE INVENTION

1. Cross-reference to Related Application

This application claims priority based upon my copending Provisional Application Ser. No. 60/040,004, filed Mar. 3, 1997.

2. Field of the Invention

The present invention relates generally to scrubbing implements, and, more particularly, to a scrubbing implement especially adapted for use with a spray bottle.

3. Description of the Prior Art

Often when cleaning activities are carried out, a two-part activity is undertaken. One cleaning activity is to apply a liquid cleaner. The other activity to carry out a cyclic scrubbing action with a solid scrubbing device. Throughout the years, a number of innovations have been developed relating to both applying a liquid cleaner and carrying out a scrubbing action, and the following U.S. patents are representative of some of those innovations: U.S. Pat. Nos. 2,388,605, 2,722,701, 3,088,164, 4,464,072, 4,922,859. More specifically, U.S. Pat. No. 2,388,605 discloses a liquid applicator with a brush that is powered by a mechanized source of air pressure. For purposes of simplicity and economy, it would be desirable if a liquid applicator with a brush were provided which employs a hand-pumped source of air pressure.

U.S. Pat. No. 2,722,701 discloses a liquid applicator with a sponge that uses a liquid-filled squeeze bulb for applying the liquid. If a leak were to develop in the squeeze bulb, then liquid would spill out. In this respect, it would be desirable if a liquid applicator were provided which does not employ a liquid-filled squeeze bulb.

U.S. Pat. No. 3,088,164 discloses a pressurized and sealed can with an attached brush. Pressurized and sealed cans are generally not refillable. In this respect, it would be desirable if a liquid applicator with a brush were provided in which the liquid container is refillable.

U.S. Pat. No. 4,464,072 discloses a liquid applicator with a brush in which a spray nozzle is set off to the side of the brush. The spray pattern and the brush pattern are offset are offset with this device. For more efficient cleaning, it would be desirable if a spray applicator with a brush were provided in which the spray pattern and the brush pattern are not offset from each other.

U.S. Pat. No. 4,922,859 discloses a liquid dispensing head attachment which is attached to a hand-pumped spray bottle. Each of the individual dispensing elements in the head are bristle-like and have hollow interior channels. However, for purposes of simplicity and economy, it would be desirable if bristles in the head were not hollow and were in the form of a bristle-containing brush.

Thus, while the foregoing body of prior art indicates it to be well known to use liquid applicators in combination with a brush, the prior art described above does not teach or suggest a scrubber attachment for a spray bottle which has the following combination of desirable features: (1) employs a hand-pumped source of air pressure; (2) does not employ a liquid-filled squeeze bulb; (3) provides a liquid container which is refillable; (4) provides a spray pattern and a brush pattern are which not offset from each other; (5) and provides bristles which are not hollow and which are in the form of a bristle-containing brush. The foregoing desired characteristics are provided by the unique scrubber attachment for spray bottle of the present invention as will be made apparent from the following description thereof. Other advantages of the present invention over the prior art also will be rendered evident.

SUMMARY OF THE INVENTION

To achieve the foregoing and other advantages, the present invention, briefly described, provides a scrubber attachment for a spray bottle which includes a spray nozzle. The scrubber attachment includes a base member which includes a top side, a bottom side, and a communication channel extending through the base member from the top side to the bottom side. Scrubber members are connected to the top side of the base member astride the communication channel. A bottle connector is attached to the bottom side of the base member for connecting the scrubber attachment to the spray bottle. The scrubber attachment of the invention permits a surface to be treated with a liquid spray and scrubbed with scrubber members by using a one-handed operation.

The bottle connector includes a flexible, tubular, connector sleeve placed in registration with the communication channel. The connector sleeve may be connected to the base member by a rotatable connection. The rotatable connection may include an annular recess in the base member which is in registration with the communication channel and may also include a flanged end on the connector sleeve which fits into the annular recess in the base member. The scrubber members include bristles.

The spray nozzle of the spray bottle protrudes from a sprayer housing, and the connector sleeve fits onto the protruding spray nozzle by a friction fit. The scrubber members are distributed symmetrically around the communication channel on the base member.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved scrubber attachment for spray bottle which has all of the advantages of the prior art and none of the disadvantages.

It is another object of the present invention to provide a new and improved scrubber attachment for spray bottle which may be easily and efficiently manufactured and marketed.

It is a further object of the present invention to provide a new and improved scrubber attachment for spray bottle which is of durable and reliable construction.

An even further object of the present invention is to provide a new and improved scrubber attachment for spray bottle which is susceptible of a low cost of manufacture with regard to both materials and labor, and which accordingly is then susceptible of low prices of sale to the consuming public, thereby making such scrubber attachment for spray bottle available to the buying public.

Still yet a further object of the present invention is to provide a new and improved scrubber attachment for spray bottle which employs a hand-pumped source of air pressure.

Still another object of the present invention is to provide a new and improved scrubber attachment for spray bottle that does not employ a liquid-filled squeeze bulb.

Yet another object of the present invention is to provide a new and improved scrubber attachment for spray bottle which provides a liquid container which is refillable.

Even another object of the present invention is to provide a new and improved scrubber attachment for spray bottle that provides a spray pattern and a brush pattern are which not offset from each other.

Still a further object of the present invention is to provide a new and improved scrubber attachment for spray bottle which provides bristles which are not hollow and which are in the form of a bristle-containing brush.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved scrubber attachment for spray bottle embodying the principles and concepts of the present invention will be described.

Figure 1:
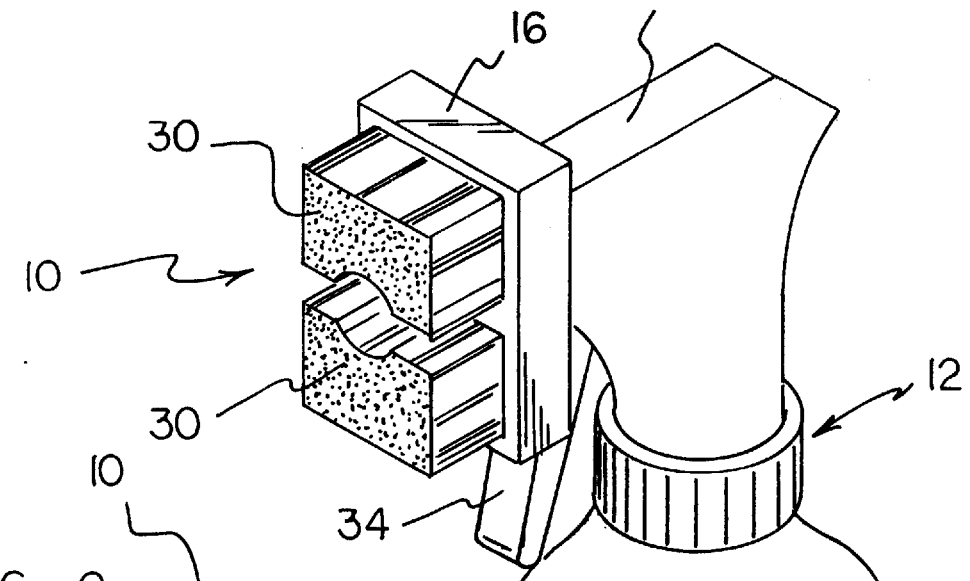
FIG. 1 is a top perspective view showing a preferred embodiment of the scrubber attachment for spray bottle attached to a spray bottle.
Figure 2:
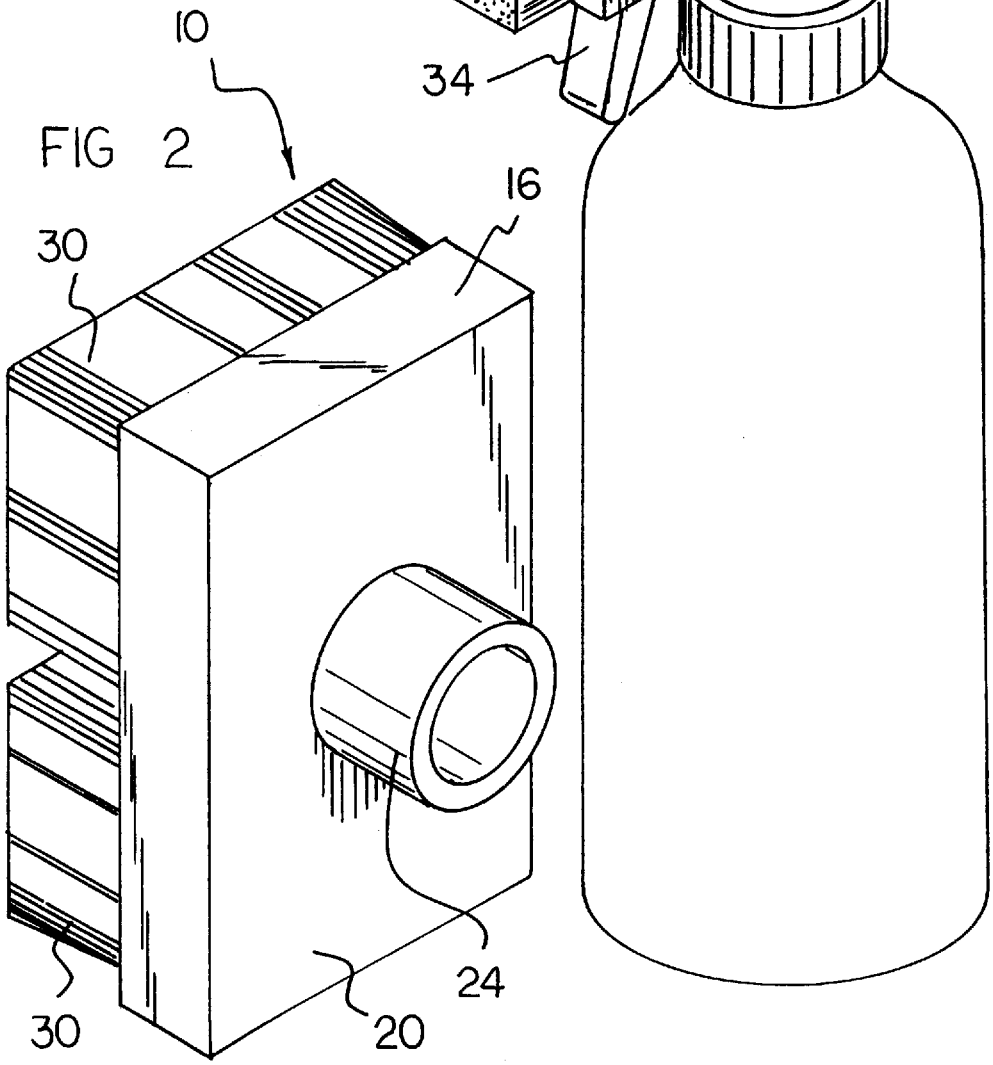
FIG. 2 is an enlarged bottom perspective view of the scrubber attachment for spray bottle of the invention of FIG. 1 removed from the spray bottle.
Figure 3:
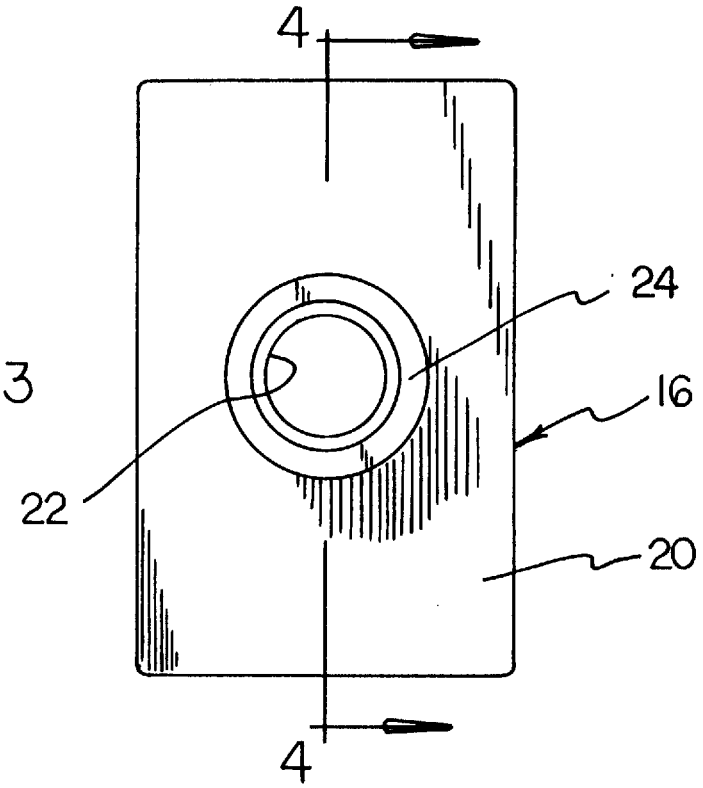
FIG. 3 is a bottom view of the embodiment of the invention shown in FIG. 2.
Figure 4:
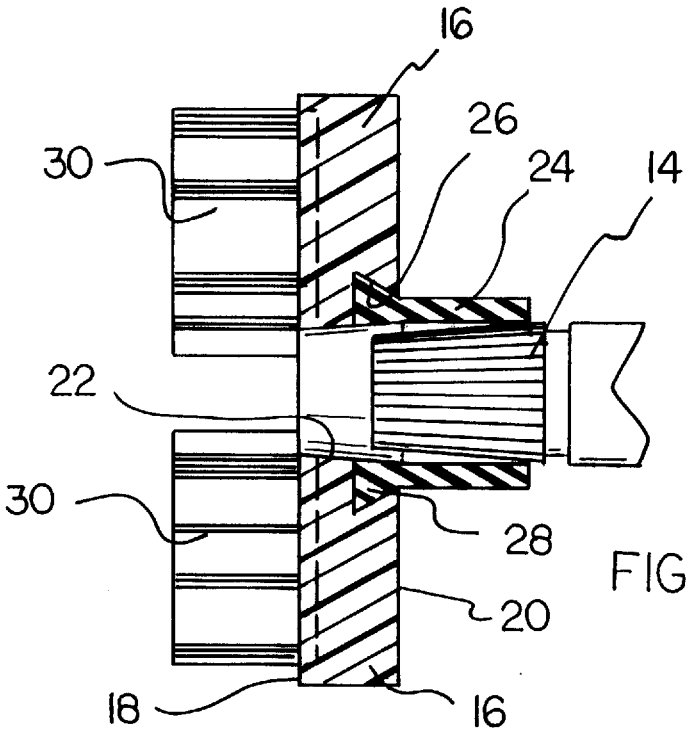
FIG. 4 is a cross-sectional view of the embodiment of the invention shown in FIG. 3 taken along line 4—4 thereof and connected to a spray nozzle by a friction fit.

Turning to FIGS. 1–4, there is shown an exemplary embodiment of the scrubber attachment for spray bottle of the invention generally designated by reference numeral 10. In its preferred form, scrubber attachment 10 is provided for a spray bottle 12 which includes a spray nozzle 14. The scrubber attachment 10 includes a base member 16 which includes a top side 18, a bottom side 20, and a communication channel 22 extending through the base member 16 from the top side 18 to the bottom side 20. Scrubber members are connected to the top side 18 of the base member 16 astride the communication channel 22. A bottle connector is attached to the bottom side 20 of the base member 16 for connecting the scrubber attachment 10 to the spray bottle 12. The scrubber attachment 10 of the invention permits a surface to be treated with a liquid spray and scrubbed with scrubber members by using a one-handed operation. Because a person's second hand is free, the second hand can be used for wiping or drying the treated surface, or the second hand can be used to hold the surface in position for cleaning.

The bottle connector includes a flexible, tubular, connector sleeve 24 placed in registration with the communication channel 22. The connector sleeve 24 may be connected to the base member 16 by a rotatable connection. The rotatable connection may include an annular recess 26 in the base member 16 which is in registration with the communication channel 22 and may also include a flanged end 28 on the connector sleeve 24 which fits into the annular recess 26 in the base member 16. The scrubber members include bristles 30. Alternatively, the scrubber members could be sponge members.

The spray nozzle 14 of the spray bottle 12 protrudes from a sprayer housing 32, and the connector sleeve 24 fits onto the protruding spray nozzle 14 by a friction fit. The scrubber members are distributed symmetrically around the communication channel 22 on the base member 16.

To use the scrubber attachment 10 of the invention, the scrubber attachment 10 is grasped in a person's hand, and the connector sleeve 24 is pushed onto the protruding spray nozzle 14 of the spray bottle 12. When the handle 34 of the spray bottle 12 is pumped, liquid spray emerges from the spray nozzle 14 and passes through the communication channel 22 to the top side 18 of the base member 16 and emerges therefrom to fall on a surface to be treated. A very common form of treatment may be cleaning with a detergent. At the same time, the bristles 30 can be resting on that surface to be treated, and the person holding the spray bottle 12 can move the spray bottle 12 in a circular or oscillating manner. As this is done, the bristles 30 scrub the surface to be treated, and the surface to be treated is scrubbed with the liquid that is sprayed onto the surface.

The scrubber attachment 10 of the invention can be used in a wide variety of surface treating applications which include tire side walls, barbecue grills, vinyl tops of cars, fabric seat covers, shirt collars, marker lights on tractor trailer trucks, reflector tape, among many others.

If desired, a model of the scrubber attachment 10 can be provided that fits onto a plumbing-attached kitchen sink sprayer so that the scrubber attachment 10 of the invention can aid in cleaning vegetables and doing dishes.

The components of the scrubber attachment for spray bottle of the invention can be made from inexpensive and durable plastic materials.

It is apparent from the above that the present invention accomplishes all of the objects set forth by providing a new and improved scrubber attachment for a spray bottle that is low in cost, relatively simple in design and operation, and which may advantageously employs a hand-pumped source of air pressure. With the invention, a scrubber attachment for spray bottle is provided which does not employ a liquid-filled squeeze bulb. With the invention, a scrubber attachment for spray bottle provides a liquid container which is refillable. With the invention, a scrubber attachment for spray bottle provides a spray pattern and a brush pattern are which not offset from each other. With the invention, a scrubber attachment for spray bottle provides bristles which are not hollow and which are in the form of a bristle-containing brush.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

What is claimed as being new and desired to be protected by Letters Patent of the United States is as follows:

1. A scrubber attachment for a source of fluid which source includes a spray nozzle, said attachment comprising:

a rectangular-shaped base member which includes a top side, a bottom side, and a communication channel extending through said base member from said top side to said bottom side, first and second scrubber members connected to said top side of said base member astride said communication channel, each of said first and second scrubber members comprising respective groups of bristles extending from said top side of said base member, the adjacent confronting edges of said groups of bristles being shaped to define a transverse slot separating said groups of bristles on opposite sides of said communication channel, said communication channel defining a circular opening in said top side of said base member, each of said bristle group edges having a semi-circular central portion proximal to said circular opening whereby said slot extends transversely across said top side of said base member and said semi-circular central portions of said bristle group edges surround said circular opening, nozzle connection means, said nozzle connection means being connected to said bottom side of said base member for connecting the scrubber attachment to said nozzle wherein said nozzle connection means includes a flexible, tubular, connector sleeve placed in registration with said communication channel, wherein said sleeve is connected to said base member by a rotatable connection, and wherein said rotatable connection includes:

an annular recess in said base member which is in registration with said communication channel, and a flanged end on said connector sleeve which fits into said annular recess in said base member.

2. The apparatus of claim 1 wherein connector sleeve is adapted to fit onto said spray nozzle by a friction fit between said spray nozzle and said connector sleeve.

* * * * *